United States Patent [19]

Ogata et al.

[11] 4,367,624

[45] Jan. 11, 1983

[54] CONTROL SYSTEM FOR HYDRAULIC ACTUATOR

[75] Inventors: Yasuhiro Ogata; Norishige Mutou, both of Hirakata, Japan

[73] Assignee: Kabushiki Kaisha Komatsu Seisakusho, Tokyo, Japan

[21] Appl. No.: 121,735

[22] Filed: Feb. 15, 1980

[30] Foreign Application Priority Data

Feb. 20, 1979 [JP] Japan ..... 54-19754[U]

[51] Int. Cl.[3] ..... F15B 11/16

[52] U.S. Cl. ..... 60/484; 60/486; 91/6; 91/509

[58] Field of Search ..... 91/6, 509, 519, 521, 91/523, 529, 461; 60/486, 484

[56] References Cited

U.S. PATENT DOCUMENTS

| | | | |
|---|---|---|---|
| 2,336,955 | 12/1943 | Ott | 91/6 |
| 3,355,994 | 12/1967 | Malott | 91/509 |
| 3,817,153 | 6/1974 | Zunzer | 91/529 |
| 3,835,647 | 9/1974 | Huffman | 91/6 |
| 3,952,510 | 4/1976 | Peterson | 60/486 |
| 4,112,821 | 9/1978 | Bianchetta | 91/6 |
| 4,142,445 | 3/1979 | Lohbauer | 91/6 |
| 4,210,061 | 7/1980 | Bianchetta | 91/6 |

*Primary Examiner*—Abraham Hershkovitz
*Attorney, Agent, or Firm*—Armstrong, Nikaido, Marmelstein & Kubovcik

[57] ABSTRACT

A control system for a hydraulic actuator comprising a first pump with large displacement capacity, a second pump with small displacement capacity, a pilot pump, a first pilot operated spring centered control valve connected at the input side thereof to the first pump, the output side of which is selectively connected to the hydraulic actuator and drain, a second pilot operated spring centered control valve connected at the input side thereof to the second pump, the output side of which is selectively connected to the hydraulic actuator and drain, and a third control valve for pilot pressure connected at the input side thereof to the pilot pump, the output side of which is connected to the first and second control valves wherein the second control valve is adapted to be actuated by a pilot pressure lower than a pilot pressure which actuates the first control valve.

3 Claims, 5 Drawing Figures

CONTROL SYSTEM FOR HYDRAULIC ACTUATOR

BACKGROUND OF THE INVENTION

This invention relates to a system for controlling a hydraulic actuator such as implement cylinders or the like for use in construction vehicles like bulldozers.

As for the control device of the kind specified, there has heretofore been employed a device which is arranged to supply the fluid under pressure deliverred by a hydraulic pump driven by an engine through a control valve to an implement cylinder and a drain system.

However, such construction is disadvantageous in that when inching control of the implement cylinder is made most of the fluid under pressure deliverred by the hydraulic pump is throttled by a control valve or the flow rate of the fluid is controlled therein so that a major part of the power developped by the pump is consumed uselessly thereby generating a power loss.

In other words, at the time of full stroke operation control, all the fluid under pressure deliverred by the pump is effectively used, whilst at the time of inching control, only part of the deliverred fluid under pressure is effectively used and the rest of it is throttled causing a power loss.

Thus, the conventional control device suffers from such a disadvantage that, because a hydraulic pump having a delivery capacity to meet the flow rate of fluid at the time of full stroke operation control is used, a major part of the fluid under pressure is throttled or consumed ineffectively during inching operations thereby to cause a power loss.

SUMMARY OF THE INVENTION

It is therefore an object of the present invention to provide a control system for a hydraulic actuator which is capable of overcoming the above noted problems. Another object of the present invention is to provide a control system for a hydraulic actuator wherein large volume of hydraulic oil can be supplied to the actuator during full stroke operations while small volume of hydraulic oil can be supplied to the actuator during inching operations thereby reducing power loss at the inching operations.

A further object of the present invention is to provide a control system for a hydraulic actuator which is capable of improving response time or responsibility of the actuator during inching operations. In accordance with an aspect of the present invention, there is provided a control system for a hydraulic actuator comprising: an engine; a first hydraulic pump with large displacement capacity driven by said engine; a second hydraulic pump with small displacement capacity driven by said engine; a pilot pump driven by said engine; first pilot operated control valve means connected at the input side thereof to said first pump, the output side thereof being selectively connected to said hydraulic actuator and drain; second pilot operated control valve means connected at the input side thereof to said second pump, the output side thereof being selectively connected to said hydraulic actuator and drain; and third control valve means for pilot pressure connected at the input side thereof to said pilot pump, the output side thereof being connected to said first and second pilot operated control valve means wherein said second pilot operated control valve means is adapted to be actuated by a pilot pressure lower than a pilot pressure which actuates said first pilot operated control valve means whereby said hydraulic actuator is operated by hydraulic fluid from said second pump during inching operations of said third control valve means for pilot pressure and is operated by hydraulic fluid from both said first and second pumps when said third control valve means for pilot pressure is fully operated.

The above and other objects, features and advantages of the present invention will be readily apparent from the following description taken in conjunction with the accompanying drawings.

DETAILED DESCRIPTION OF THE INVENTION

Figure 1:
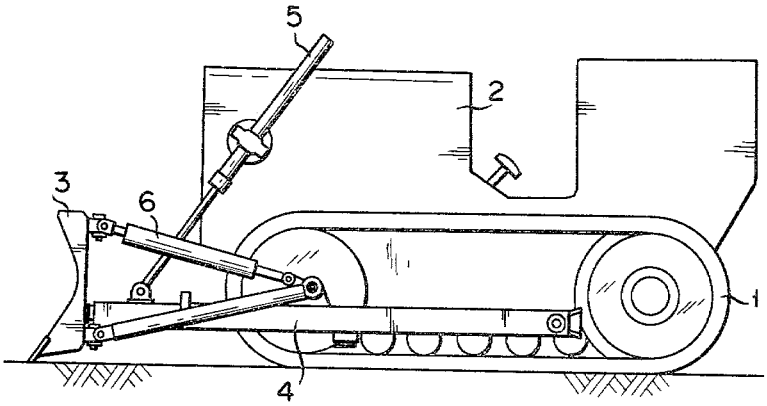
FIG. 1 is a side elevational view of a bulldozer employing a control system for a hydraulic actuator according to the present invention.

The present invention will now be described below by way of example only with reference to the accompanying drawings.

Pivotally mounted through a frame 4 on a vehicle body 2 having an endless track 1 is a blade 3 which can be turned freely in the vertical direction. A pair of blade cylinders 5 are pivotally connected between the frame 4 and the body 2, and a tilt cylinder 6 is pivotally connected between the frame 4 and the blade 3.

Figure 2:
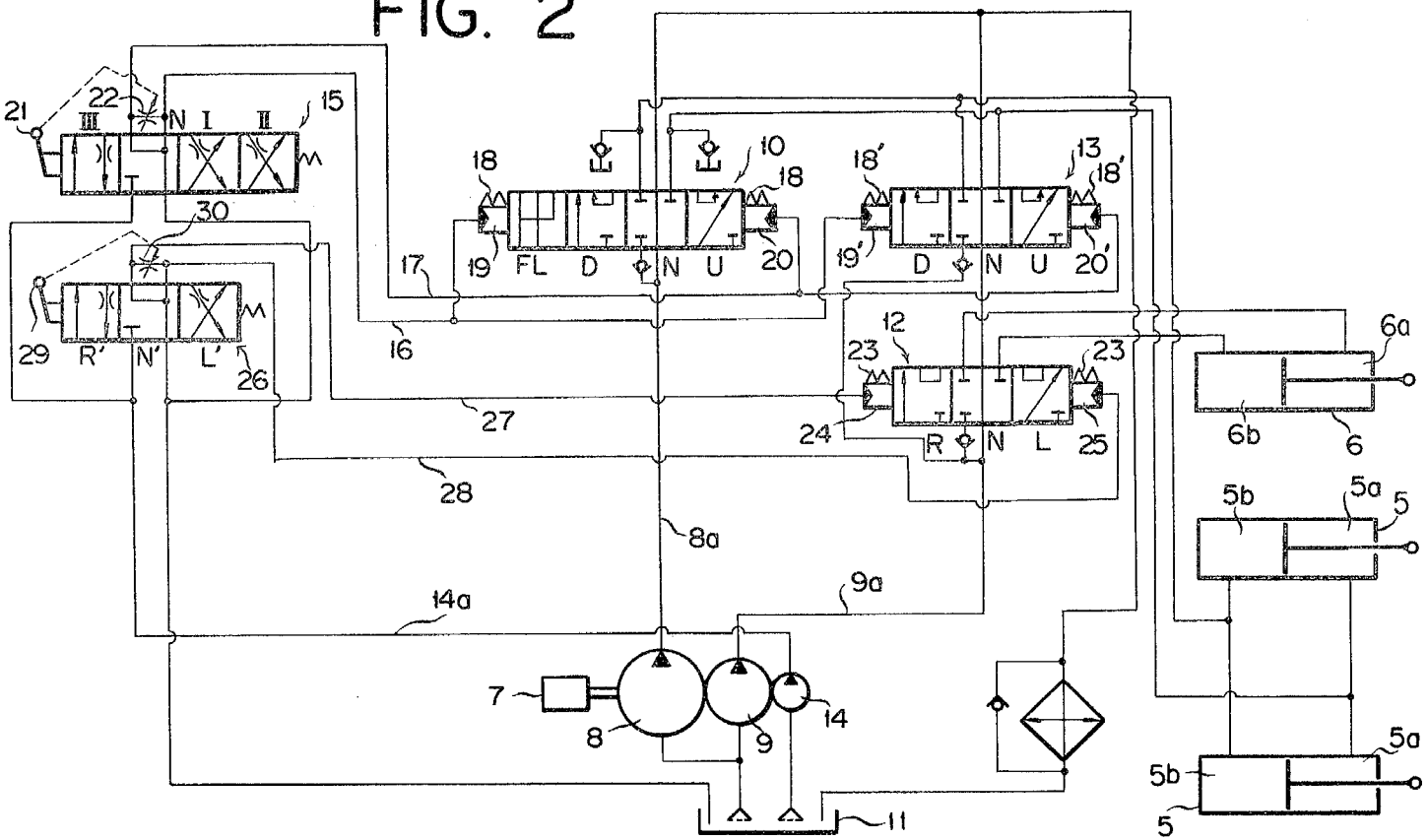
FIG. 2 is a hydraulic circuit of a control system for a hydraulic actuator according to the present invention.

FIG. 2 shows a hydraulic circuit for controlling the above-mentioned blade cylinders 5 and tilt cylinder 6. The hydraulic circuit comprises a pump 8 having a large capacity driven by an engine 7 and a pump 9 having a small capacity also driven thereby. The delivery side 8*a* of the pump 8 is connected through a pilot operated four-position first blade lifting valve 10 (referred to as the first blade lifting valve below) to lifting chambers 5*a* of the blade cylinders 5, lowering chambers 5*b* of the same and drain 11. Whilst, the delivery side 9*a* of the small capacity pump 9 is connected to a pilot operated three-position tilting valve 12 and a pilot operated three-position second blade lifting valve 13 (referred to as second blade lifting valve below). The second blade lifting valve 13 is connected to the lifting chambers 5*a* of the blade cylinders 5, the lowering chambers 5*b* thereof and the drain 11. Whilst, the pilot operated three-position tilting valve 12 is connected to a rightward tilting chamber 6*a* of the tilt cylinder 6, a leftward tilting chamber 6*b* and the drain 11.

Reference numeral 14 denotes a pilot pump, the delivery side 14*a* of which is connected through a pilot pressure control valve 15 to a first pilot conduit 16 and a second pilot conduit 17. The constructions of the valves 10, 12, 13 and 15 will be described below.

The first blade lifting valve 10 is a pilot operated four-position valve which is adapted to be kept at its neutral position N by a pair of centering springs 18, 18 and occupy a lowering position D and a floating position FL by the pilot pressure supplied into a first pilot pressure receiving port 19 thereof and also occupy a lifting position U by the pilot pressure fed into a second pilot pressure receiving port 20 thereof.

Figure 4:
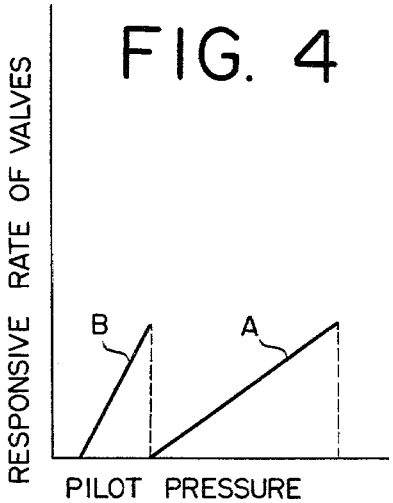
FIG. 4 is a diagram showing a relationship between the pilot pressure and the responsive rate of blade lift valves wherein A denotes first blade lift valve and B represents second blade lift valve.

The second blade lifting valve 13 has the similar construction as the first blade lifting vlave 10 except it has not the floating position FL. This is a pilot operated three-position valve adapted to be kept at its neutral position N by a pair of centering springs 18', 18' and occupy a lowering position D by the pilot pressure introduced into a first pilot pressure receiving port 19' thereof and also occupy a lifting position U by the pilot pressure introduced into a second pilot pressure receiving port 20' thereof. The centering springs 18' are set to have a resilient force weaker than those of the centering springs 18 of the first blade lifting valve 10, and also the rate of change of displacement of the centering springs 18' against the amount of variation of the pilot pressure is set to be smaller than those of the centering spring 18. Stating briefly, the amount of opening of the second blade lifting valve 13 in response to changes in the pilot pressure is larger than that of the first blade lifting valve 10. (Refer to a diagram in FIG. 4). In FIG. 4, reference character A denotes the amount of opening of the first blade lifting valve 10, and B that of the second blade lifting valve 13.

The pilot pressure control valve 15 can be changed over by means of a control lever 21 to either of neutral position N, first and second positions I, II at which the pilot pressure is supplied into the first pilot conduit 16 and a third position III at which the pilot pressure is supplied into the second pilot conduit 17. The first pilot conduit 16 is connected to the first pilot pressure receiving ports 19 and 19' of the first and second blade lifting valves 10 and 13, respectively. Whilst, the second pilot conduit 17 is connected to the second pilot pressure receiving ports 20 and 20' of the first and second blade lifting valves 10 and 13, respectively. The first and second conduits 16 and 17 are interconnected or by-passed through an adjustable restrictor 22. The adjustable restrictor 22 is interlocked with the control lever 21 so as to vary the degree of restriction thereof in proportion to the stroke or the amount of operation of the lever.

The pilot operated three-position tilting valve 12 is arranged to be kept at its neutral position N by a pair of centering springs 23, 23 and can be changed over to a rightward tilting position R by the pilot pressure supplied to a first pilot pressure receiving port 24 and also to a leftward tilting position L by the pilot pressure supplied to a second pilot pressure receiving port 25. The pilot pressure is supplied into the first and second pilot pressure receiving ports 24 and 25 through a pilot pressure control valve 26 for tilting which is installed on the delivery side 14*a* of the pilot pump 14. Stating in brief, the pilot pressure control valve 26 for tilting can be changed over by a control lever 29 to either of a rightward tilting position R' at which a pilot pressure is supplied into a first pilot conduit 27 connected to the first pilot pressure receiving port 24, a leftward tilting position L' at which a pilot pressure is supplied into a second pilot conduit 28 connected to the second pilot pressure receiving port 25 and a neutral position N'. The first and second pilot conduits 27 and 28 are interconnected or by-passed through an adjustable restrictor 30 which is interlocked with the control lever 29 so as to vary its degree of restriction in proportion to the stroke of the lever.

The operation of the system will now be described below. When the pilot pressure control valve 15 is moved to its first position I by means of the control lever 21, the pilot pressure is directly introduced into the first pilot conduit 16 and is supplied into the first pilot pressure receiving ports 19 and 19' of the first and second blade lifting valves 10 and 13, respectively. Whilst, the pilot pressure is also supplied through the adjustable restrictor 22 and the second pilot conduit 17 into the second pilot pressure receiving ports 20 and 20', respectively.

Figure 5:
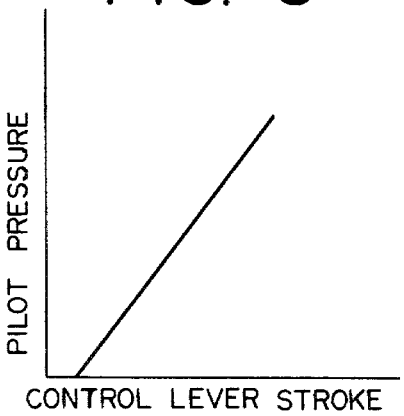
FIG. 5 is a diagram showing a relationship between the control lever stroke and the pilot pressure.

Since, at that time, the degree of restriction of the adjustable restrictor 22 will increase in proportion to the increase of the stroke of the control lever 21, the pressure $P_1$ in the first pilot conduit 16 becomes higher than the pressure $P_2$ in the second pilot conduit 17. (In consequence, the pilot pressure will increase in proportion to the increase of the stroke as shown in FIG. 5.) If the pressure differential $P_1-P_2$ becomes higher than the resilient forces of the centering springs 18', 18' of the second blade lifting valve 13, the latter will occupy its lowering position D so as to permit the fluid under pressure delivered by the small capacity pump 9 to be supplied into the lowering chambers 5*b* of the blade cylinders 5. At that time, the pressure differential $P_1-P_2$ is less than the resilient forces of the centering springs 18, 18 of the first blade lifting valve 10, and therefore the first blade lifting valve 10 will remain in neutral position N so as to permit the pressurized fluid delivered by the large capacity pump 8 to flow into the drain 11.

Therefore, at the time of inching operation or when the stroke of the control lever 21 is small, only the pressurized fluid delivered by the small capacity pump 9 is supplied into the blade cylinders 5, and the fluid delivered by the large capacity pump 8 will flow into the drain 11. As a result, the power loss can be reduced, and because the volume of the fluid to be supplied can be varied to a large extent in response to the stroke of the lever, the response of the control device can be improved remarkably and the inching operation control can be effected easily.

When the control lever 21 is moved further, the degree of restriction of the adjustable restrictor 22 will increase further so as to increase the pressure differential $P_1-P_2$ between the first and second pilot conduits 16 and 17. When the pressure differential $P_1-P_2$ becomes higher than the resilient forces of centering springs 18, 18 of the first blade lifting valve 10, the first blade lifting valve 10 will occupy its lowering position D so as to permit the pressurized fluid delivered by the large capacity pump 8 to be supplied into the lowering side chambers 5*b* of the blade cylinders 5.

Therefore, at the time of full stroke operation, the fluid under pressure delivered by both the large capacity pump 8 and the small capacity pump 9 is supplied into the lowering side chambers 5*b* of the blade cylinders 5. Consequently, a large flow quantity of pressurized fluid can be supplied so as to enable the blade cylinders 5 to be actuated at a high pressure and a high speed, and also the change of the flow quantity of the fluid in response to the stroke of the lever can be reduced thereby improving the fine control characteristics of the control device.

If the control lever 21 is moved still further, so as to permit the pilot pressure control valve 15 to occupy its second position II, the aforementioned pressure differential $P_1 - P_2$ will increase further so that the first blade lifting valve 10 may occupy its floating position FL thereby enabling the blade 3 to be kept under floating condition.

Figure 3:
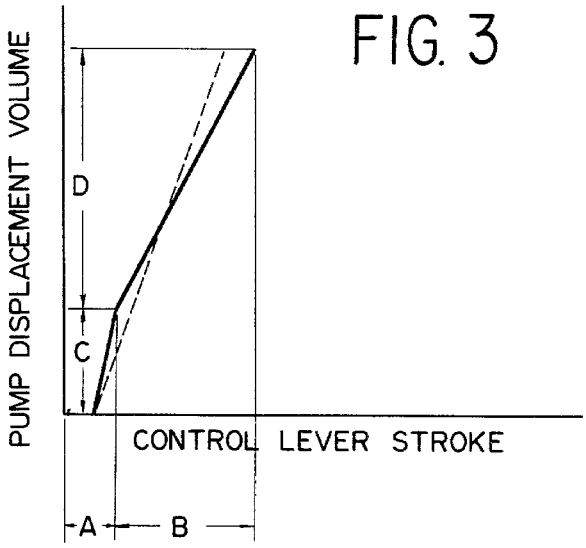
FIG. 3 is a diagram showing the relationship between the control lever stroke and the displacement volume of the pump wherein solid line represents the present invention and dotted line shows prior art system.

FIG. 3 is a diagram showing the ralationship between the delivery volume of the pump and the stroke of the control lever in which solid line shows the performance of one embodiment of the present invention, and dotted line shows that of the conventional control device. Reference numeral A indicates the extent of inching operation control, B the extent of full stroke operation, C the delivery volume of the small copacity pump, D that of the large capacity pump and C+D the total delivery volumes of the large and small capacity pumps.

This diagram proves that the present invention is superior to the conventional one in the response characteristics at the time of inching operation stroke and the fine control characteristics at the time of full stroke operation.

Further, since the tilting cylinder 6 is actuated by the pressurized fluid delivered by the small capacity pump 9 through the pilot operated three-position titling valve 12, when actuating the tilting cylinder 6, the pressurized fluid delivered by the large capacity pump 8 is permitted to flow out into the drain 11 thereby reducing the power loss.

Stating briefly, when the pilot pressure control valve 26 for tilting is moved to the rightward tilting position R' by means of the control lever 29, a pilot pressure is supplied through the conduit 27 into the first pilot pressure receiving ports 24 so as to permit the tilting valve 12 to occupy its rightward tilting position R. As a result, the fluid under pressure delivered by the small capacity pump 9 is supplied into the rightward tilting chamber 6a of the tilt cylinder 6. Moreover, the same principle is applied in case of leftward tilting, and so its detailed description is omitted herein.

The foregoing description is made for the case of lowering the blade, however, the same principle is applicable in the case of lifting the blade and so its description is omitted.

Further, although the aforementioned embodiment is described with reference to the control circuit for the blade cylinder, it can of course be applied to control circuits for other purposes.

Since the present invention is constructed as mentioned hereinabove, at the time of full stroke operation, a large flow quantity of pressurized fluid can be supplied to the hydraulic actuators 5, whilst at the time of inching operation, only a small flow quantity of pressurized fluid can be supplied to the actuators 5 thereby reducing the power loss remarkably, and also both the response characteristics of the control device at the time of inching operation and the fine control characteristics thereof at the time of full stroke operation can be improved.

It is to be understood that the above description is by way of example only, and that details for carrying the invention into effect may be varied without departing from the scope of the invention claimed.

What we claim is:

1. A control system for controlling a hydraulic actuator during full stroke operations and inching operations, said control system comprising:

an engine;

a first hydraulic pump with a large displacement capacity driven by said engine;

a second hydraulic pump with a small displacement capacity driven by said engine;

a pilot pump driven by said engine;

first pilot operated control valve means connected at the input side thereof to said first pump, the output side thereof being selectively connected to said hydraulic actuator and a drain;

second pilot operated control valve means connected at the input side thereof to said second pump, the output side thereof being selectively connected to said hydraulic actuator and a drain wherein said second pilot operated control valve means is actuated by a lower pilot pressure than said first pilot operated control valve means; and third control valve means for pilot pressure connected at the input side thereof to said pilot pump, the output side thereof being connected to said first and second pilot operated control valve means for controlling the actuation thereof, such that, during full stroke operations, said first and second pilot operated control valve means are actuated by said third control valve means such that said hydraulic actuator is operated by hydraulic fluid from said first and second hydraulic pumps and during inching operations, only said second pilot operated control valve means is operated by said third control valve means such that said hydraulic actuator is operated by hydraulic fluid from only said second hydraulic pump, wherein each of said first and second pilot operated control valve means has two pilot ports formed therein one of which is connected to said third control valve means for pilot pressure through a first conduit, the other port being connected to said third control valve means for pilot pressure through a second conduit and wherein adjustable restrictor means is provided between said first and second conduits, said restrictor means being interlocked with lever means for operating said third control valve means for pilot pressure.

2. A control system for a hydraulic actuator as recited in claim 1 wherein said first pilot operated control valve means is spring centered type and has four positions formed therein and said second pilot operated control valve means is also spring centered type and has three positions formed therein.

3. A control system for a hydraulic actuator as recited in claim 1 further comprising another hydraulic actuator; fourth pilot operated control valve means connected at the input side thereof to said second pump, the output side thereof being selectively connected to said another actuator and drain; and fifth control valve means for pilot pressure connected at the input side thereof to said pilot pump, the output side thereof being connected to said fourth pilot operated control valve means.

* * * * *